US006853804B2

(12) United States Patent
Whitinger

(10) Patent No.: US 6,853,804 B2
(45) Date of Patent: Feb. 8, 2005

(54) ICE AND SNOW REMOVAL SYSTEM

(76) Inventor: Thad Whitinger, 2210 Arielle Dr., Unit 1101, Naples, FL (US) 34109-3302

( * ) Notice: Subject to any disclaimer, the term of this patent is extended or adjusted under 35 U.S.C. 154(b) by 114 days.

(21) Appl. No.: 10/139,315

(22) Filed: May 7, 2002

(65) Prior Publication Data

US 2003/0210903 A1 Nov. 13, 2003

(51) Int. Cl.[7] ..... H05B 3/78

(52) U.S. Cl. ..... 392/488; 392/486; 219/213; 137/357; 165/171

(58) Field of Search ..... 392/488, 472, 392/478, 480, 481, 482, 486, 497; 219/213, 528, 534, 535, 549; 137/357, 356, 338, 45, 46, 47, 49, 56, 171; 122/14.2; 165/45.46, 47, 49, 56, 171

(56) References Cited

U.S. PATENT DOCUMENTS 4,725,713 A * 2/1988 Lehrke ..... 392/472
4,880,051 A * 11/1989 Ohashi ..... 165/45
5,591,365 A * 1/1997 Shields ..... 219/213
5,703,998 A * 12/1997 Eckman ..... 392/497
5,836,344 A * 11/1998 Hovi, Sr. ..... 137/357
5,930,457 A * 7/1999 Tourangeau ..... 219/535
6,166,352 A * 12/2000 Turton ..... 219/213
6,180,929 B1 * 1/2001 Pearce ..... 219/528
6,561,138 B2 * 5/2003 Kobayashi et al. ..... 122/14.2

* cited by examiner

*Primary Examiner*—Fadi H. Dahbour
(74) *Attorney, Agent, or Firm*—Edward M. Livingston

(57) ABSTRACT

One or more dispensing conveyances (1) have outlet apertures (2) or conveying and dispensing heated water to surfaces of roofs (3) and other structural surfaces selectively when ice and snow is being accumulated or has accumulated thereon. The water is heated with an electric-resistance (7, 10) or optionally with a fuel-flame heater (8, 11), which can be a tank heater or a tankless geyser water heater. Electric-resistance members can be positioned inside of heat-resistant tubular conveyances proximate the outlet apertures. A programmable control unit (18) can be included for programmable heat, flow rate and flow time.

12 Claims, 4 Drawing Sheets

ICE AND SNOW REMOVAL SYSTEM

BACKGROUND OF THE INVENTION

1. Field of the Invention

This invention relates to removal and prevention of accumulation of ice and snow on roofs and other surfaces by dispensing heated water onto the roofs or other surfaces from a dispenser conveyance.

2. Relation to Prior Art

Accumulation of ice and snow on roofs, driveways, bridges, and other structural surfaces has long been a problem in cold climates. Prior art generated for its prevention and removal has included variations of circulating heated water or heated air in heat-radiation conveyances on the roofs and other critical surfaces. There is no known ice-and-snow-removal system that dispenses heated water onto the roof or other structural surfaces from a dispenser in a manner taught by this invention.

Examples of most-closely related known but different devices are described in the following patent documents:

| Number | Date | Inventor | U.S. Class |
|---|---|---|---|
| US 5,836,344 | Nov. 17, 1998 | Hovi, Sr. | 137/357 |
| US 4,880,051 | Nov. 14, 1989 | Ohashi | 165/45 |

SUMMARY OF THE INVENTION

Objects of patentable novelty and utility taught by this invention are to provide an ice-and-snow removal system which:

can be used to prevent or to remove accumulation of ice and snow from roofs and other structural surfaces;

can be made portable for use on select roofs and other surfaces; and can be positioned wherever found to be most effective on roofs, driveways, bridges and other structural surfaces.

This invention accomplishes these objectives with one or more tubular conveyances having outlet apertures for conveying and dispensing heated water to surfaces of roofs and other structural surfaces selectively when ice and snow is being accumulated or has accumulated thereon. The water is heated preferably, but not necessarily, with an electric-resistance geyser to avoid tankage losses. Electric-resistance members can be positioned inside of the conveyances proximate the outlet apertures and the tubular conveyances can be heat resistance to further economize the system.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
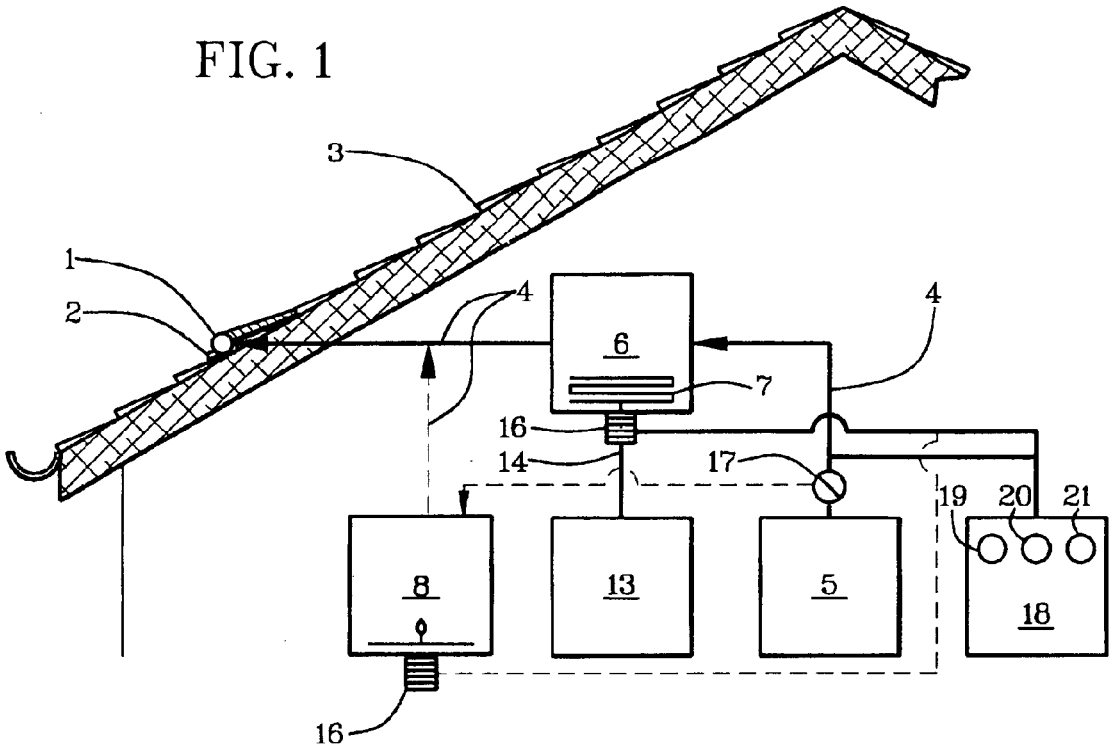
FIG. 1 is a fragmentary elevation view of a gable end of a roof that is representative of structural surfaces on which the ice-and-snow removal system is positioned for dispensing hot water from outlet apertures in a dispensing conveyance to which the hot water is conveyed from a water heater having a water-heater tank that includes optionally an electrical-resistance water heater or a fuel-flame water heater with a tank-water conveyance in fluid communication intermediate the water heater and the dispensing conveyance as controlled optionally by heater controls and dispensing controls.

Listed numerically below with reference to the drawings are terms used to describe features of this invention. These terms and numbers assigned to them designate the same features throughout this description.

1. Dispensing conveyance
2. Outlet aperture
3. Roof
4. Water-source conveyance
5. Water source
6. Water-heater tank
7. Electrical-resistance heater
8. Fuel-flame water heater
9. Geyser water heater
10. Electric geyser heater
11. Fuel geyser heater
12. Electrical resistor
13. Electrical source
14. Electrical lead
15. Heat-resistant walls
16. Heat controller
17. Flow controller
18. Programmable control unit
19. Flow-rate programmer
20. Heat-rate programmer
21. Time programmer -continued 22. Portability platform
23. Runners
24. Snow
25. Driveway
26. Sprinkler Referring to FIGS. 1–2, at least one dispensing conveyance 1, which is preferably a tubular member, has at least one outlet aperture 2 for conveying and dispensing heated water to a surface of a roof 3 or other structural surface selectively when ice and snow is being accumulated or has accumulated thereon. A water-source conveyance 4 is in fluid communication of water from a water source 5 to the dispensing conveyance 1. The dispensing conveyance 1 is articulated to be positioned on or above the roof 3 of other structural surface predeterminedly.

A water heater is positioned intermediate the water source 5 and the outlet aperture 2. As shown in FIG. 1, the water heater can include a water-heater tank 6 that has optionally an electrical-resistance heater 7 or a fuel-flame water heater 8.

Figure 2:
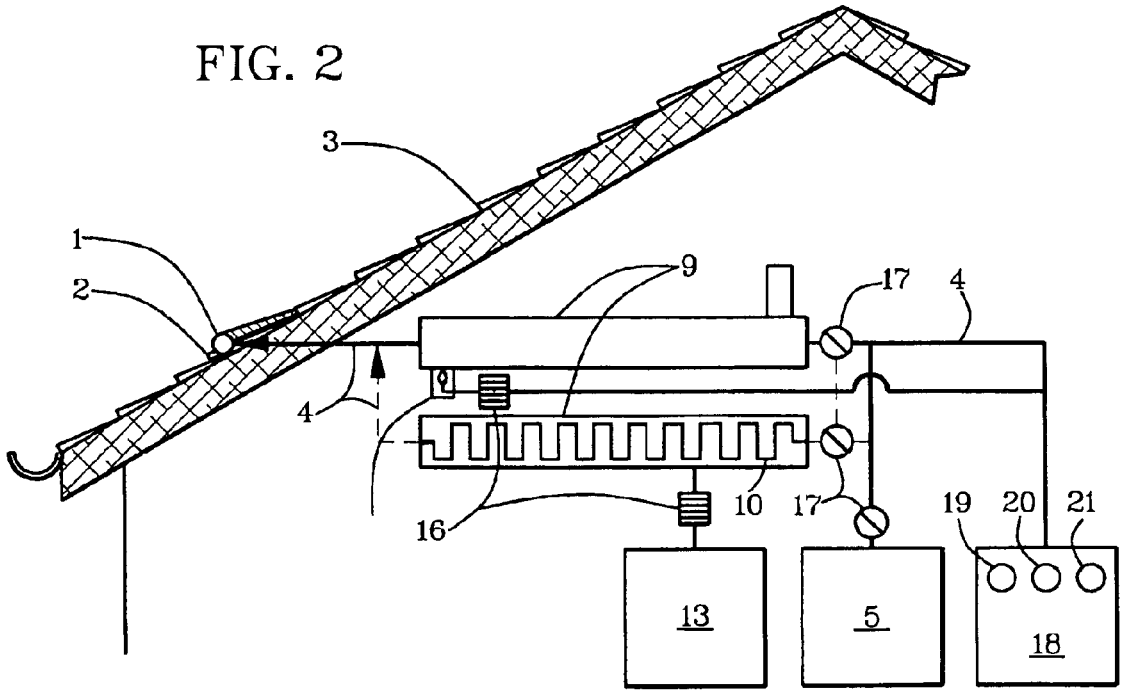
FIG. 2 is the fragmentary elevation view of the gable end of the roof on which the ice-and-snow removal system is positioned for dispensing hot water from the outlet apertures of a dispensing conveyance to which the hot water is conveyed from a geyser water heater that includes optionally an electrical-resistance water heater or a fuel-flame water heater with a tankless fluid communication intermediate a water source and the dispensing conveyance as controlled optionally by heater controls and dispensing controls.
Figure 3:
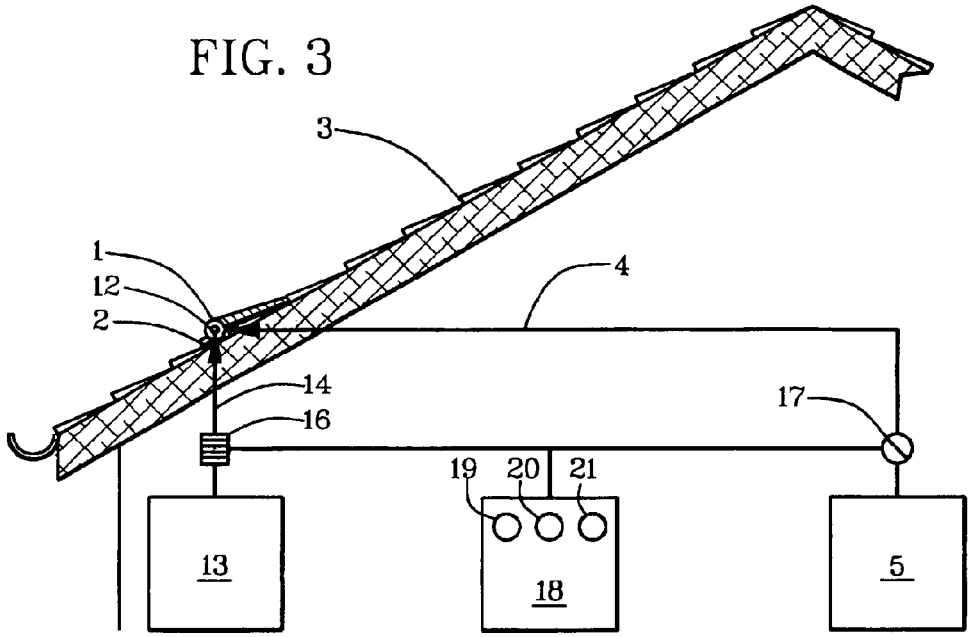
FIG. 3 is the fragmentary elevation view of the gable end of the roof on which the ice-and-snow removal system is positioned for dispensing hot water from outlet apertures of a dispensing conveyance that is a tubular member inside of which the geyser water heater that includes the electrical-resistance heater is positioned for tankless fluid communication intermediate the dispensing conveyance and at least one outlet aperture as controlled optionally by the heater controls and dispensing controls.
Figure 4:
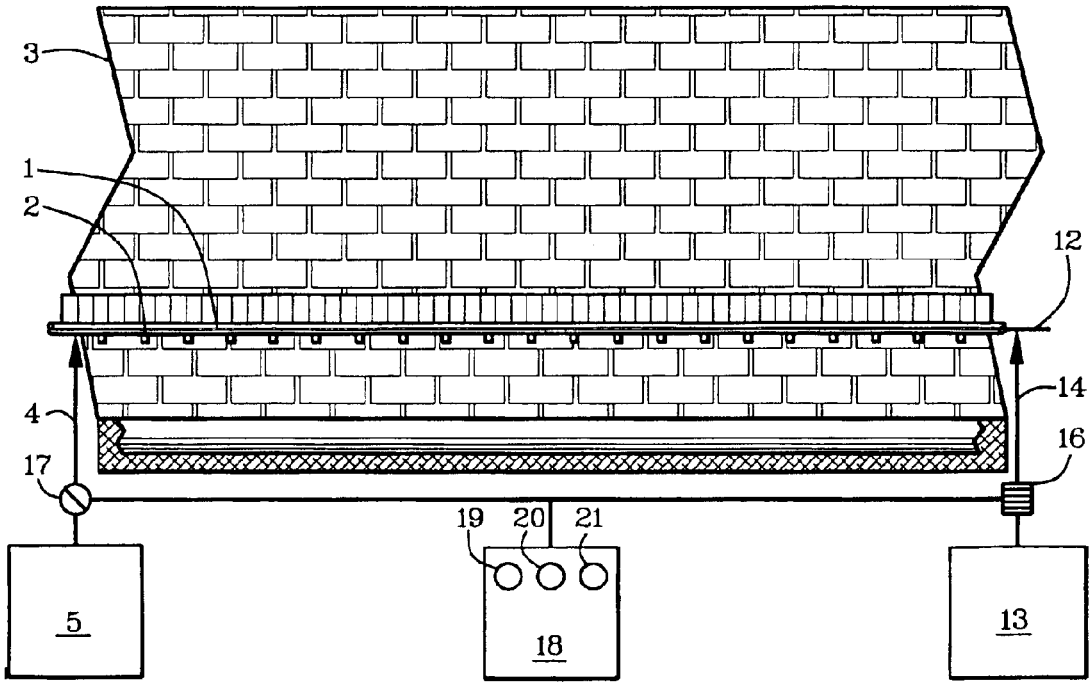
FIG. 4 is a fragmentary side view of the FIG. 3 illustration.

Optionally, as shown in FIG. 2, the water heater can include a geyser water heater 9 having tankless fluid communication intermediate the water source 5 and the dispensing conveyance 1. The geyser water heater 9 can include an electric geyser heater 10 or a fuel geyser heater 11.

Referring to FIGS. 3–6, the electric geyser heater 10 can include an electrical resistor 12 in the dispensing conveyance 1, which is preferably the tubular member. Electrical current to the electrical resistor 12 can be routed from an electrical source 13 through an electrical lead 14.

Figure 5:
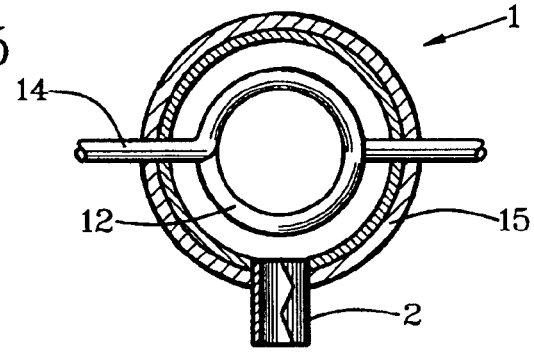
FIG. 5 is a section view of a tubular dispensing conveyance through either of a plurality of the outlet apertures.
Figure 6:
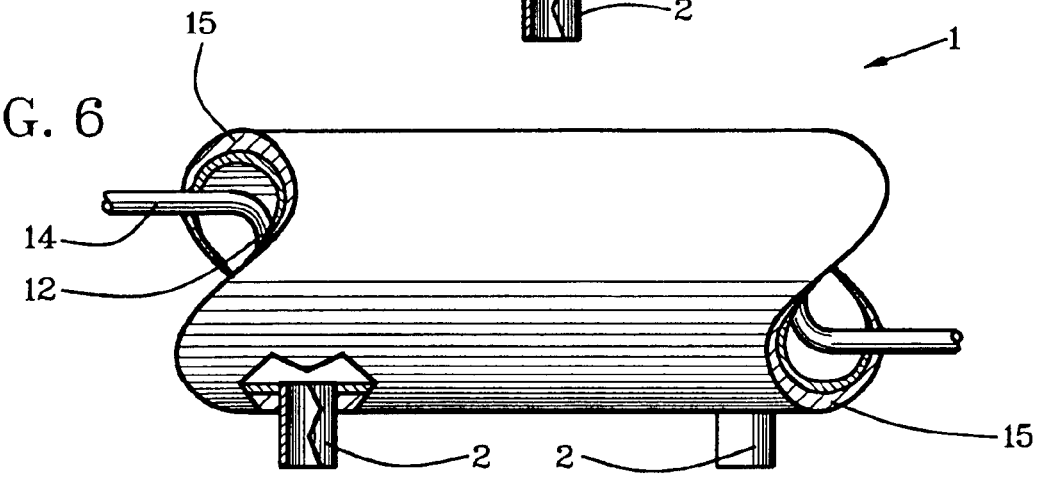
FIG. 6 is a partially cutaway fragmentary side view of the dispensing conveyance intermediate two adjacent outlet apertures as shown in FIGS. 1–2 and having the electrical resistor as shown in FIGS. 3–5 and 7.

The tubular member of the dispensing conveyance 1 can include heat-resistance walls 15 as shown in FIGS. 5–6 for resisting dissipation of heat from water heated in the tubular member prior to dispensing of the water as heated water on the roof 3 or other structure.

Generally, the roof 3 or other structural member is slanted and the dispensing conveyance 1 is positioned proximate a predeterminedly high position vertically on the roof 3 or other structural surface for allowing flow of heated water from the at least one outlet aperture 2 for heat exchange from the heated water to ice and snow on the roof 3 or other structural surface selectively as shown in FIGS. 1–4.

Figure 7:
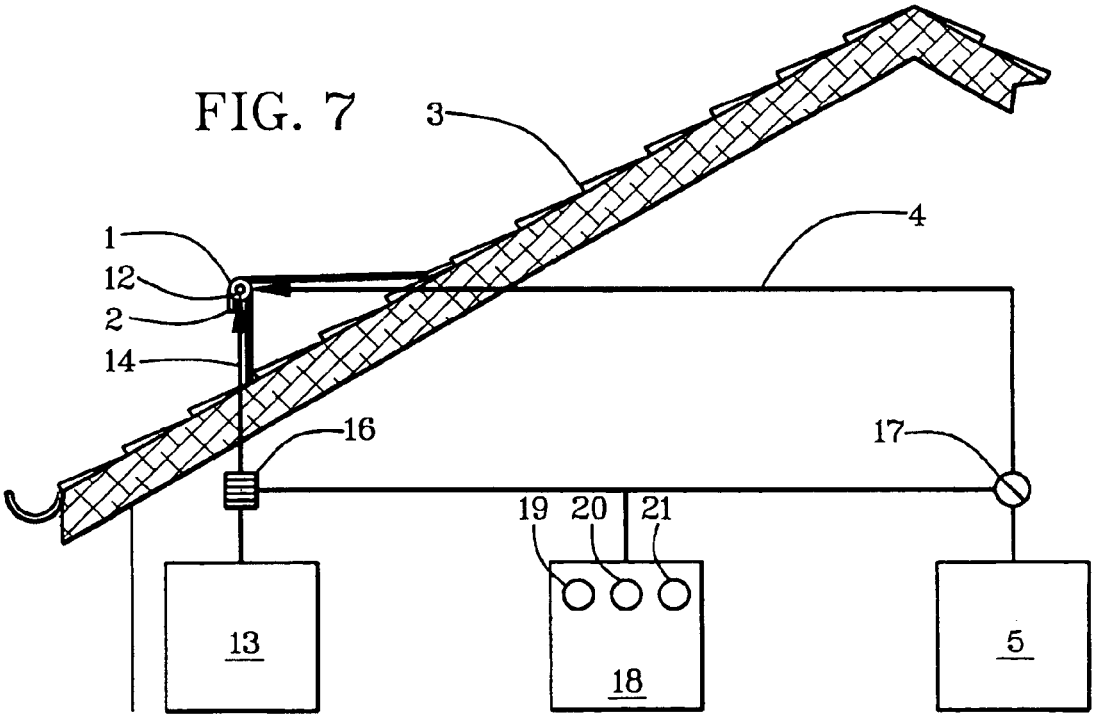
FIG. 7 is the fragmentary elevation view of the gable end of the roof above which the ice-and-snow removal system is positioned for dispensing hot water downwardly onto the roof from the dispensing conveyance shown in FIGS. 3–6 as controlled optionally by the heater controls and dispensing controls.

As shown in FIG. 7, however, the dispensing conveyance 1 can be positioned proximate a predeterminedly high position vertically above the roof 3 or other structural member for allowing outlet of heated water from the at least one outlet aperture 2 for heat exchange from the heated water to ice and snow on the roof 3 or other structural surface selectively.

Optionally, as shown in FIGS. 1–4 and 7, the snow-and-ice removal system can include a heat controller 16 in control communication with the water heater for controlling heat of water and can include a flow controller 17 in control communication with the water source 5 for controlling flow of the water to the outlet aperture 2. Also included can be a programmable control unit 18 in programmable control of the heat controller 16 and the flow controller 17. The programmable control unit 18 can include a flow-rate programmer 19 in control communication with the heat controller 16, a heat-rate programmer 20 in control communication with the heat controller 16, and a time programmer 21 with which the flow-rate programmer 19 and the heat-rate programmer 20 are time-programmable.

Figure 8:
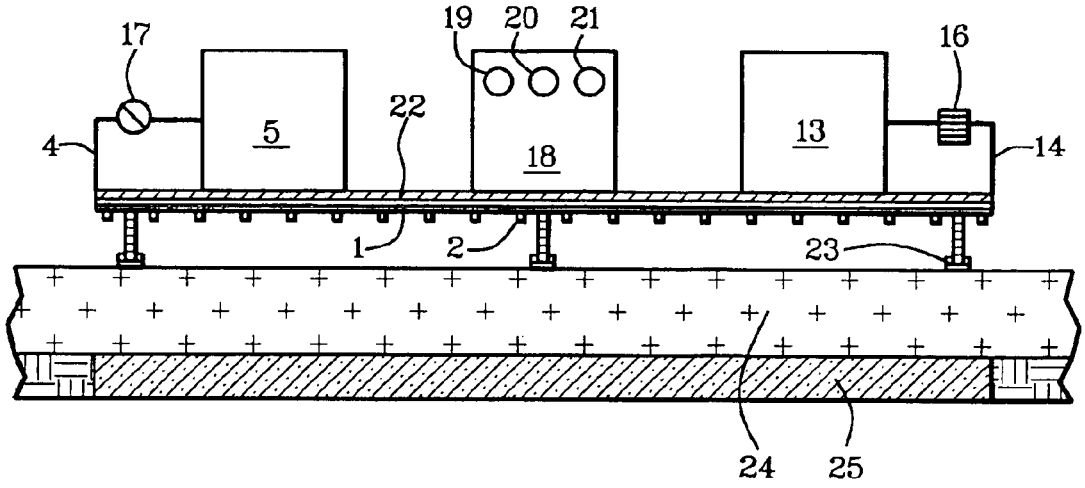
FIG. 8 is a rear view of a portable ice-and-snow removal system positioned on runners and shown atop of snow and ice on a representation of a driveway.
Figure 9:
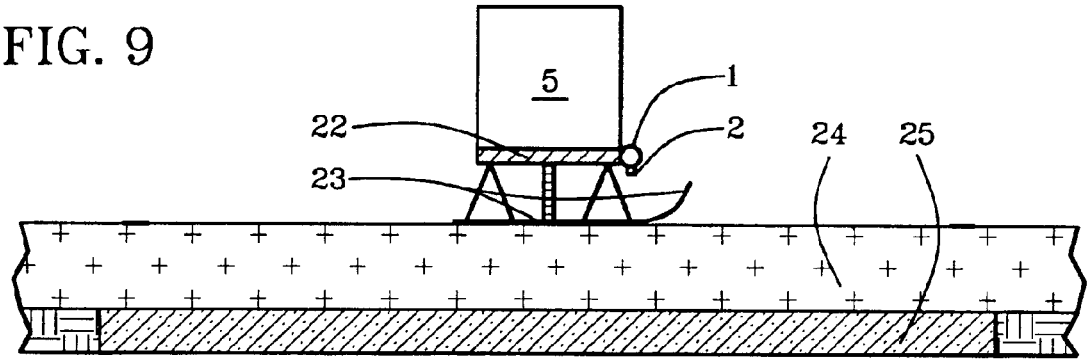
FIG. 9 is a side view of the FIG. 8 illustration.
Figure 10:
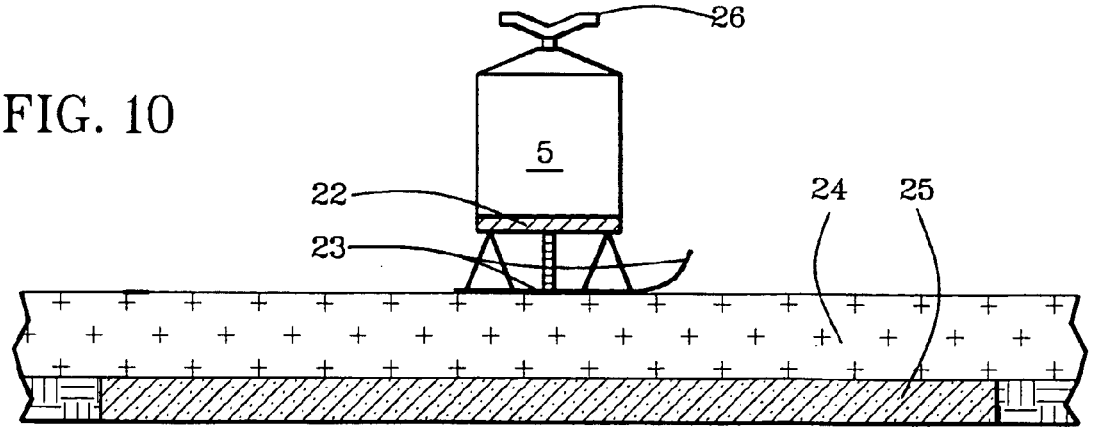
FIG. 10 is a side view of a sprinkler ice-and-snow removal system on runners.

Referring to FIGS. 8–10, the ice-and-snow removal system can be portable on a portability platform 22 that is mobile on preferably runners 23 shown on snow 24 above a driveway 25. Optionally also, the dispensing conveyance 1 can include a sprinkler 26 that is portable.

The water source 5 for portable embodiments can include hoses from either the water-heater tank 6 tank, the fuel-flame water heater 8 or the geyser water heater 9 as described in relation to FIGS. 1–2.

Portability on the runners 23 is similar to moveableness on the roof 3 as described in relation to FIGS. 1–4 and 7.

A new and useful ice-and-snow removal system having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An ice-and-snow removal system comprising:

at least one dispensing conveyance having at least one outlet aperture for conveying and dispensing heated water to a surface of a roof or other structural surface selectively when ice and snow is being accumulated or has accumulated thereon;

a water-source conveyance in fluid communication of water from a water source to the dispensing conveyance;

the dispensing conveyance being articulated to be positioned on the roof or other structural surface for dispensing the heated water predeterminedly; and a water heater intermediate the water source and the outlet aperture wherein the water heater includes a water-heater tank with a tank-water conveyance in fluid communication intermediate the water heater and the dispensing conveyance wherein:

the water heater includes a geyser water heater having tankless fluid communication intermediate the water source and the dispensing conveyance.

2. The ice-and-snow removal system of claim 1 wherein:

the geyser water heater includes an electric geyser heater.

3. The ice-and-snow removal system of claim 1 wherein:

the geyser water heater includes a fuel geyser heater.

4. The ice-and-snow removal system of claim 2 wherein:

the electric geyser heater is in the dispensing conveyance.

5. The ice-and-snow removal system of claim 4 wherein:

the dispensing conveyance is a tubular member; and the electrical-resistance heater is an electrical resistor inside of the tubular member.

6. The ice-and-snow removal system of claim 5 wherein:

the tubular member includes heat-resistance walls for resisting dissipation of heat from water heated in the tubular member prior to dispensing of the water as heated water onto the roof or other structural surface.

7. The ice-and-snow removal system of claim 5 wherein:

the roof or other structural member is slanted; and the dispensing conveyance is positioned proximate a predeterminedly high position vertically on the roof or other structural surface for allowing flow of heated water from the at least one outlet aperture and heat exchange from the heated water to ice and snow on the roof or other structural surface selectively.

8. The ice-and-snow removal system of claim 6 wherein;

the roof or other structural member is slanted; and the dispensing conveyance is positioned proximate a predeterminedly high position on the roof or other structural surface for allowing flow of heated water from the at least on outlet aperture for exchange from the heated water to ice and snow on the roof or other structural surface selectively.

9. The ice-and-now removal system comprising:

at least one dispensing conveyance having at least one outlet aperture for conveying and dispensing heated water to a surface of a roof or other structural surface selectively when ice and snow is being accumulated or has accumulated thereon;

a water-source conveyance in fluid communication of water from a water source to the dispensing conveyance;

the dispensing conveyance being articulated to be positioned on the roof or other structural surface for dispensing the heated water predeterminedly;

a heat controller in control communication with the water heater for controlling heat of the water;

a flow controller in control communication with the water source for controlling flow of the water to the outlet aperture; and a programmable control unit in programmable control of the heat controller and the flow controller.

10. The ice-and-snow removal system claim 9 wherein;

the programmable control unit includes a flow-rate programmer in control communication with the flow controller.

11. The ice-and-snow removal system of claim 9 wherein the programmable control unit includes a heat-rate programmer in control communication with the heat controller.

12. The ice-and-snow removal system of claim 10 wherein:

the flow-rate programmer and the heat-rate programmer are time-programmable with a time programmer.

* * * * *